United States Patent [19]

Zander

[11] 4,412,625

[45] Nov. 1, 1983

[54] CHILD-PROOF PILL CONTAINER FOR HANDICAPPED

[76] Inventor: Patricia J. Zander, 508 Brevoort La., Rye, N.Y. 10580

[21] Appl. No.: 348,678

[22] Filed: Feb. 16, 1982

[51] Int. Cl.[3] ..... B65D 43/14; B65D 47/08; B65D 55/02; B65D 83/04

[52] U.S. Cl. ..... 215/223; 206/528; 206/536; 220/329; 220/345; 220/DIG. 13; 222/557

[58] Field of Search ..... 206/528, 529, 530, 531, 206/532, 533, 534, 534.1, 534.2, 535, 536, 537, 538, 539, 540; 221/10, 12, 206, 207, 303, 306; 220/293, 297, 300; 215/222, 223; 222/153, 557, 560

[56] References Cited

U.S. PATENT DOCUMENTS

| | | | |
|---|---|---|---|
| D. 189,372 | 11/1960 | Adell | 215/1 R |
| 1,221,838 | 4/1917 | Crist | 222/557 |
| 2,287,625 | 6/1942 | Leach | 222/557 |
| 2,391,347 | 6/1943 | Punte | 206/42 |
| 2,878,977 | 3/1959 | Pugh | 222/557 |
| 3,313,441 | 4/1967 | Fadden | 215/76 |
| 3,425,578 | 2/1969 | Owens | 206/536 |
| 3,678,884 | 7/1972 | Robbins | 206/539 |
| 3,759,420 | 9/1973 | Karkanen | 206/536 |
| 3,860,111 | 1/1975 | Thompson | 206/540 |
| 3,889,847 | 6/1975 | Uroshevich et al. | 221/265 |
| 4,095,178 | 6/1978 | Kong | 215/223 |
| 4,127,190 | 11/1978 | Sunnen | 206/538 |
| 4,141,461 | 2/1979 | LaChance | 220/253 |
| 4,183,443 | 1/1980 | De Parales et al. | 222/557 |
| 4,203,532 | 5/1980 | Mar | 222/153 |

FOREIGN PATENT DOCUMENTS

| | | | |
|---|---|---|---|
| 1032769 | 4/1953 | France | 206/539 |
| 1503515 | 3/1978 | United Kingdom | 222/557 |

*Primary Examiner*—George E. Lowrance
*Assistant Examiner*—Jimmy G. Foster
*Attorney, Agent, or Firm*—Donald W. Meeker

[57] ABSTRACT

A pill container and permanently attached cap form a three-sided prism-shaped safety bottle. The container is provided with a top to which the cap is secured permanently by a large-headed shaft from the cap protruding into the container top through an elongated slot with a detent at each end. A slot in one side of the cap rides on a track protruding from the top of the container. An indented section of the cap fits within a dispenser opening on top of the track. Pushing from one side causes the cap to move laterally along a straight portion of the track while the shaft is forced through the tight slot from the first detent to the second. The cap is then pivoted around the shaft, guided by a curved portion of track. A protrusion on the track stops the cap rotation when the opening is exposed to dispense the pills one at a time therethrough. Strength but not manual dexterity is required for the two discrete opening steps.

10 Claims, 6 Drawing Figures

CHILD-PROOF PILL CONTAINER FOR HANDICAPPED

DESCRIPTION

1. Field of Invention

The present invention relates to movable or removable closures for receptacles which closures provide obstructive means to negate easy or what would appear normal removal of the closure and in particular, devices wherein the closure and the receptacle portion cooperating therewith include structure requiring sequential rotary and axial movement therebetween, such sequential movement allowing closure removal in a step-by-step manner.

2. Background Art

Although there have been some notable improvements made in the area of childproof containers, little thought has been given to the requirements that the elderly and handicapped users might have for operating safety caps. In light of this unfortunate omission, there have been a few closures presented in the art which purport to solve the problem, but fall short in their solutions. Some, although "childproof" and easily operated by the elderly or infirm, cannot be manufactured except at a very high cost. Other solutions require a complicated opening procedure. Furthermore, the cylindrical shape of prior art containers does not offer a secure grasping surface nor an efficient means of storing, as much space is wasted between bottles of circular cross-section.

DISCLOSURE OF INVENTION

The principle object of the invention is to provide an improved childproof closure for a pill dispensing container.

A further object of the invention is to provide a childproof closure which would be opened easily by the elderly and handicapped, employing a two-step opening procedure: first, pushing on one of the flat sides of the three-sided cap, disengaging the mechanism from its locked position, and then positioning the cap into a pivotal mode, thereby allowing the cap to be rotated to reveal an opening wich is sufficient in diameter to allow the dispensing of a single pill at a time only. In addition, the triangular cross-sectional shape of the cap and container allows the elderly user a firmer grasp for manipulation.

Another object of the invention is to provide relatively low-cost manufacturing capabilities: the cantainer being made of blow-molded plastic and the closure cap being made of a two-piece injection-molded plastic.

It is also as object of the invention to provide a container whose triangular cross-sectional shape makes packaging, storage and display very efficient in terms of leaving a minimum amount of space lost between containers, unlike the substantial amount of space wasted between containers of cylindrical cross-section.

An additional object of the invention is to provide an ease of assembly by attaching the cap permanently to the container with one snapping movement of the post of the cap into the detente of the container.

A further object of the invention is to provide a unique product identity to the manufacturer because of the container/closure's singular triangular shape.

Another object of the invention is to provide a cap which, because of its permanent attachment, cannot be dropped or lot my the user.

One more object of the invention is to provide an opening in which the diameter of the opening accommodates the dispensing of single pills at one time only.

BRIEF DESCRIPTION OF THE DRAWINGS

These and other details and advantages of my invention will be described in connection with the accompanying drawings, which are furnished only by way of illustration and not in limitation of the invention, and in which.

PREFERRED EMBODIMENT OF THE INVENTION

Figure 1:
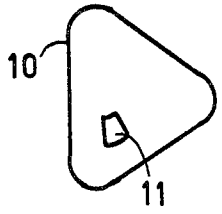
FIG. 1 is a plan view of the childproof container in its closed position.
Figure 2:
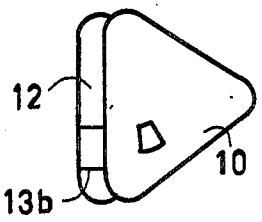
FIG. 2 is a plan view of the invention in step one of a two-step opening procedure.
Figure 3:
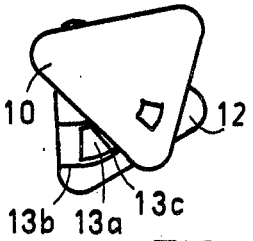
FIG. 3 is a plan view which shows the cap and container in the open position.

Referring to FIGS. 1–3 of the drawings, numeral 10 designates the cap top which is in the closed position in FIG. 1. Numeral 12 designates the top of the bottle which is revealed when the cap 10 is pushed forward into a position in FIG. 2 which allows the cap 10 to rotate counterclockwise to the position of FIG. 3, exposing the container opening 13*a*. A cap niche 11 provides a space in the top of the cap for holding pills and at the same time seals the container opening when the cap is in the closed position.

Figure 4:
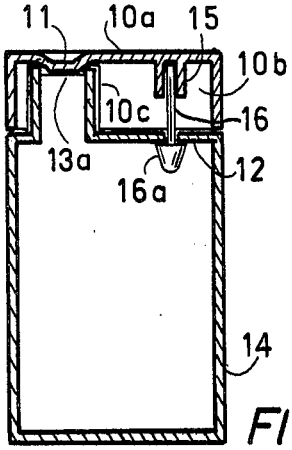
FIG. 4 is a sectional view taken along the line 4—4 of FIG. 5.

In FIG. 4, a three-sided prism-shaped container 14 is fitted with a closure cap 10 which includes a flat top 10*a* and and three orthogonal side walls 10*b*. Protruding downward from the flat top 10*a* are an indented niche 11 and a boss 15 fitted with a pivoting post 16 having an inverted cone-shaped tip 16*a* which is the means for holding the cap permanently in place on the container top 12. In the closed position, as in FIG. 4, the niche 11 or indentation of the flat cap top fits snugly into the container opening 13*a* which is made through the top surface of an elevated track 13 for guiding the motion of the cap 10. A rectangular slot 10*c* cut from one side of the cap straddles the track for guiding the motion of the cap. The pivoting post 16 is locked into the detent hole 17*a* in the closed position, as in FIGS. 4 or 5. Extending inwardly along the top surface of the container 12 the first detent 17*a* is connected to a second detent 17*b* by a straight slot 17 therebetween. The slot 17 is narrower than the diameter of the post 16 and a substantial force is required to move the post through the slot because of the friction between the post and the semiflexible top of the container 12.

Figure 5:
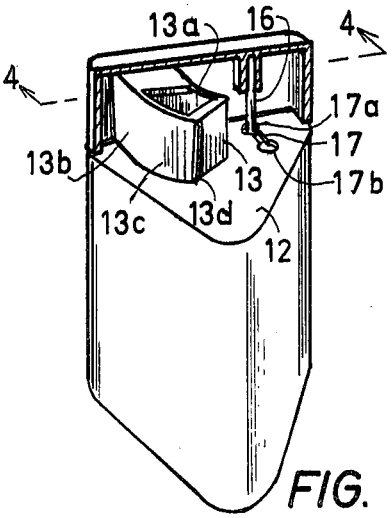
FIG. 5 is a partial cross-section perspective view showing the container and cap in the closed position.
Figure 6:
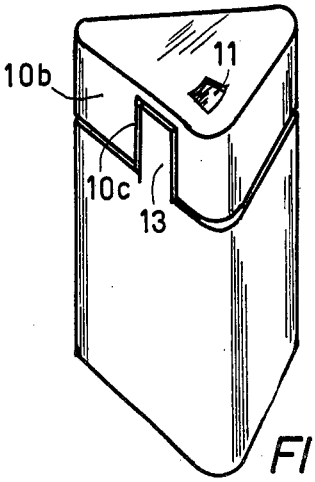
FIG. 6 is a perspective view of the invention in the closed position.

In FIGS. 3 and 5 the elevated track 13 of rectangular cross-section matching the slot 10*c* in the side of the cap, extends from the edge of the container in a straight portion 13*b*, parallel and equal in length to the straight portion of the slot 17 in the container top, and continuing into a curved portion 13*c*, having as its center of curvature the center of the second detent 17*b*, which is circular and about the same diameter as the shaft 16 to permit rotation of the shaft therein, and possibly slightly smaller in diameter to restrain the rotation of the shaft therein.

To open the pill bottle, a two-step operation is employed as shown in FIGS. 2 and 3. By pushing with a substantial force on the cap side 10*b* provided with the guide slot 10*c*, the cap moves laterally and the pivoting post 16 leaves the first detent 17*a* and simultaneously the cap indentation or niche 11 pops forward out of the container opening 13*a* providing a straight lateral motion of the cap 10 along the top of the container guided by the travel of the cap slot 10*c* along the straight portion 13*b* of the track and also by the travel of the post 16 in the container top slot 17 until the post rests within the second detent 17*b* which is the pivoting detent. When the post 16 is locked into the pivoting detent 17*b*, the cap 10 can then be rotated counterclockwise to reveal the opening 13*a* as in FIG. 3. The cap slot 10*c* is guided by the curved track portion 13*c* until rotation around the pivoting post is stopped when the cap slot 10*c* abutts a stop protruding 13*d* from the side of the inner end of the track 13. At that point the cap 10 will be clear of the container opening 13*a* so that pills may be dispensed through the opening, which should be shaped and sized to permit only a single pill at a time to be dispensed. If circular tablets are dispensed, the width of the container opening 13*a* should be slightly greater than the diameter of the tablet and narrower than two tablet thicknesses, thereby allowing the dispensing of one tablet at a time with a shaking movement. The protruding track 13 with the opening at the top serves as a directional dispenser to make it easier for a handicapped person to dispense one pill at a time to a desired location. The niche 11 on the top of the cap will then hold the tablets for subsequent use.

Any material used in fabrication of the pill dispensers should be compatible with the contents to avoid contamination of the contents and adverse effects to the user. Cap and container materials should be compatible with one another. The cap 10 is made of a suitable plastic by a two-piece injection molded process. The pivotal post 16 is molded by a secondary process and would be force fit into the molded cap boss 15. The container 14 is made of a suitable flexible plastic, such as polyethylene, using a blow-molding process. Forming the track 17, detents 17*a* and 17*b* and the opening would be a secondary process in the manufacturing.

Although there has been a notable advancement in childproof closures on bottles, until the development of the present invention, there has been a glaring omission of the needs of the elderly and the handicapped, particularly those with arthritic hands who must take many aspirins each day.

The childproof aspect is provided by the fact that an understanding of the working principle and great strength are required to push the cap laterally relative to the container, an uncommon motion in removing bottle tops. The required combination of two discrete steps, a lateral motion followed by a separate rotational motion, is nonexistant in the art and therefore is not readily obvious to the untrained observer, such as a young child who can not read instructions. With a tight-fitting cap niche 11 in the container opening and a tight-fitting cap post 16 in the container slot 17, a great deal of strength is required to overcome the resistance encountered in the two friction forces; more strength than that of a young child. The second rotary motion to pivot the cap to the open position is not obvious and also requires a good deal of strength to overcome the friction forces to reveal the opening. A final safety feature provides an opening which can be custom designed for each type of pill to be of a size and shape to release only one pill at a time through the opening.

Handicapped users such as people with arthritis have limited manual dexterity. The triangular cross-soctional shape permits gripping without the slipping common to circular pill bottles. The broad flat side face of the cap pushed in a gross lateral motion relative to the easily grasped container is an effort which requires no manual dexterity and could be performed without the use of the fingers by holding the container against the body with one palm or forearm while pushing the cap laterally with the other palm or forearm. Because the cap then overhangs the edge of the container, a similar gross movement against the overhanging cap will rotate the cap to the open position. An alternative could provide ease of rotation if the two-step opening procedure and high frictional resistance of the lateral motion were deemed sufficient to prevent opening by children.

It is understood that the the container and cap of this invention may be used for dispensing and storing contents other than pills.

It is further understood that the preceding description is given merely by way of illustration and that various modifications may be made thereto without departing from the spirit of the invention as claimed.

I claim:

1. A safety container and cap comprising:

a container component provided with a storage compartment covered by a top with an opening therethrough for dispensing contents of the container;

a cap component provided with a means to seal the opening in the top of the container;

means for securing the cap slidably and rotatably to the top of the container and means for guiding the motion of the cap relative to the container, which motion comprises two discrete steps to uncover the opening of the container, wherein the means for securing the cap to the container comprises: a rotatable member from a first component inserted within a guide portion of a second component, which guide portion permits a lateral motion of the rotatable member followed by a rotational movement of the rotatable member, and the rotatable member comprises a cylindrical shaft protruding from the cap, which shaft is provided with an enlarged end with an abrupt increase in diameter adjacent to the shaft and a tapered tip, and wherein the guide portion comprises providing the top of the container with an elongated slot having a circular enlargement of the slot at least at one end of the slot, wherein the slot width is narrower than the diameter of the protrusion, and the circular enlargement is approximately equal to the diameter of the shaft to admit the shaft without release and permit rotation of the shaft therein.

2. The invention of claim 1 wherein the means for guiding the relative motion of the cap and container comprises the shaft and slot acting in conjunction with a track protruding from the top of the container, which track comprises a straight portion parallel and equal in length to the slot and a curved portion whose center of curvature is the center of the circular enlargement and which track further comprises, at its curved end, a protrusion to act as a stop for the cap, which cap is provided with a means for straddling the track.

3. The invention of claim 1 wherein the means for guiding the relative motion of the cap and container comprises the shaft and slot acting in conjunction with a track recessed in the top of the container, which track comprises a straight portion parallel and equal in length to the slot and a curved portion whose center of curvature is the center of the circular enlargement, and which track further comprises, at its cirular end, a protrusion to act as a stop for the cap, which cap is provided with a protrusion conforming to the shape of the track and riding therein.

4. The invention of claim 1 wherein the combined cap and container when closed form a three-sided prism shaped for ease of gripping and efficiency of storing.

5. A safety container and cap comprising:

a container component provided with a storage compartment covered by a resilient but firm top enclosing surface, which top is provided with an elongated straight slot therethrough, extending from a point adjacent to an edge of the top inward, and provided at each slot end with a circular enlargement of the slot and further with a protruding track comprising a straight portion parallel and equal in length to the straight portion of the slot, which straight track portion extends from said edge of the top inward, and a curved track portion whose center of curvature is the center of the circular enlargement in the inward end of the slot, and which track is further provided with a top track surface having an opening into the storage compartment and with a side protrusion at the inward end of the track;

a cap component provided with a top portion and protruding side portions, which top portion is provided with a downwardly extending circular shaft larger in diameter than said slot width, which shaft is provided at its lower end with a tip which comprises a flat surface extending orthogonally from the shaft to a substantially greater diameter than that of the circular slot enlargements and tapering to an end smaller in diameter than said slot enlargements, which shaft is aligned with and fits within said outer circular enlargement, and one side portion of which cap is provided with a cap slot aligned with and conforming to the shape of the track on said edge of the container top, and the top of which cap is further provided with a downward indentation conforming to, aligned with and fitting within the opening in the track.

6. The invention of claim 5 wherein the combined cap and container when closed form a three-sided prism shape for ease of gripping and efficiency of storing.

7. A child-proof pill container and cap comprising:

a container component provided with a storage compartment covered by a top, which top is provided with an opening for dispensing pills and a means for guiding the motion of a cap secured thereto, wherein the means for guiding the motion of the cap provides for two discrete motions: a first lateral movement and a second rotational movement;

a cap component provided with a means to seal the opening in the top of the container and further provided with a means of permanently securing the cap slidably and rotatably to the top of the container wherein the means for securing the cap to the top of the container comprises: providing the cap with a protruding cylindrical shaft attached thereto, which shaft is provided with an enlarged end with an abrupt increase in diameter adjacent to the shaft and a tapered tip; and providing the top of the container with an elongated slot having a circular enlargement of the slot at least at one end of the slot, wherein the slot width is narrower than the diameter of the protrusion, and the circular enlargement is approximately equal to the diameter of the shaft to admit the shaft without release and permit rotation of the shaft therein.

8. The invention of claim 7 wherein the means for guiding the relative motion of the cap and container comprises the shaft and slot acting in conjunction with a track protruding from the top of the container, which track comprises a straight portion parallel and equal in length to the slot and a curved portion whose center of curvature is the center of the circular enlargement and which track further comprises, at its curved end, a protrusion to act as a stop for the cap, which cap is provided with a means for straddling the track.

9. The invention of claim 7 wherein the means for guiding the relative motion of the cap and container comprises the shaft and slot acting in conjunction with a track recessed in the top of the container, which track comprises a straight portion parallel and equal in length to the slot and a curved portion whose center of curvature is the center of the circular enlargement, and which track, further comprises, at its circular end, a protrusion to act as a stop for the cap, which cap is provided with a protrusion conforming to the shape of the track and riding therein.

10. The invention of claim 7 wherein the combined cap and container when closed form a three-sided prism shape for the ease of gripping and efficiency of storing.

* * * * *